US009648952B2

(12) United States Patent
Nuckolls

(10) Patent No.: US 9,648,952 B2
(45) Date of Patent: May 16, 2017

(54) PRESSURE RELEASE SLIDE LATCH MECHANISM

(71) Applicant: Hardware Resources, Inc., Bossier City, LA (US)

(72) Inventor: Grant Nuckolls, Bossier City, LA (US)

(73) Assignee: Hardware Resources, Inc., Bossier City, LA (US)

( * ) Notice: Subject to any disclaimer, the term of this patent is extended or adjusted under 35 U.S.C. 154(b) by 45 days.

(21) Appl. No.: 14/566,917

(22) Filed: Dec. 11, 2014

(65) Prior Publication Data

US 2015/0091424 A1 Apr. 2, 2015

Related U.S. Application Data

(63) Continuation-in-part of application No. 14/281,643, filed on May 19, 2014, which is a continuation-in-part (Continued)

(51) Int. Cl.

| | |
|---|---|
| ***A47B 88/04*** | (2006.01) |
| ***A47B 88/463*** | (2017.01) |
| ***A47B 88/487*** | (2017.01) |
| ***A47B 88/40*** | (2017.01) |
| ***A47B 88/46*** | (2017.01) |
| ***A47B 88/453*** | (2017.01) |

(52) U.S. Cl.

CPC ..... *A47B 88/463* (2017.01); *A47B 88/40* (2017.01); *A47B 88/453* (2017.01); *A47B 88/46* (2017.01); *A47B 88/487* (2017.01); *Y10T 29/49* (2015.01); *Y10T 29/49764* (2015.01)

(58) Field of Classification Search

CPC ..... A47B 88/0466; A47B 88/047; A47B 88/0477; A47B 88/14; A47B 88/16; A47B 2088/0474; A47B 88/437; A47B 88/467; A47B 88/487; A47B 88/4675; A47B 88/463; A47B 88/453; A47B 88/46; A47B 88/40; Y10T 29/49; Y10T 29/49764

See application file for complete search history.

(56) References Cited

U.S. PATENT DOCUMENTS

| | | |
|---|---|---|
| 3,203,749 A | 8/1965 | Bullock et al. |
| 3,371,968 A | 3/1968 | Loake |

(Continued)

FOREIGN PATENT DOCUMENTS

| | | |
|---|---|---|
| CA | 2573939 | 11/2007 |
| CN | 2569641 | 9/2003 |

(Continued)

*Primary Examiner* — Leslie A Nicholson, III
*Assistant Examiner* — Ryan A Doyle
(74) *Attorney, Agent, or Firm* — Schultz & Associates, P.C.

(57) ABSTRACT

A pressure release slide latch mechanism for a drawer slide assembly comprises an outer slide, an intermediate slide mounted in the outer slide, and an inner slide mounted in the intermediate slide, a channel plate having a track portion and a guide block attached to the outer slide and a carriage slidingly engaged and biased along the track portion. A pin of a follower pivotally attached to the inner slide engages the guide block to releasably maintain the drawer slide assembly in a closed position and releases upon an inward force applied to the drawer slide assembly.

17 Claims, 13 Drawing Sheets

Related U.S. Application Data of application No. 13/460,197, filed on Apr. 30, 2012, now abandoned.

(56) References Cited

U.S. PATENT DOCUMENTS

| | | | | |
|---|---|---|---|---|
| 3,801,166 | A | 4/1974 | York | |
| 3,954,315 | A | 5/1976 | Sanden | |
| 4,370,007 | A | 1/1983 | Fler | |
| 4,469,384 | A | 9/1984 | Fler et al. | |
| 4,494,806 | A | 1/1985 | Williams et al. | |
| 4,596,427 | A | 6/1986 | Pflugfelder | |
| RE32,456 | E | 7/1987 | Ishii | |
| 4,696,582 | A | 9/1987 | Kasten | |
| 4,712,845 | A | 12/1987 | Nicol | |
| 4,988,214 | A | 1/1991 | Clement | |
| 5,004,306 | A | 4/1991 | Oshida | |
| 5,230,551 | A | 7/1993 | Kramer | |
| 5,426,885 | A | 6/1995 | Wittman | |
| 5,484,197 | A | 1/1996 | Hansen et al. | |
| 5,507,571 | A | 4/1996 | Hoffman | |
| 5,634,703 | A | 6/1997 | Vonier | |
| 5,722,750 | A | 3/1998 | Chu | |
| 5,757,109 | A | 5/1998 | Parvin | |
| 5,775,788 | A | 7/1998 | Sasse et al. | |
| 5,975,662 | A | 11/1999 | Weber | |
| 6,155,661 | A | 12/2000 | O'Neil et al. | |
| 6,220,683 | B1 | 4/2001 | Chu | |
| 6,238,031 | B1 | 5/2001 | Weng | |
| 6,244,678 | B1 | 6/2001 | Dopp et al. | |
| 6,254,205 | B1 | 7/2001 | Wright et al. | |
| 6,350,001 | B1 | 2/2002 | Chu | |
| 6,450,600 | B1 | 9/2002 | Chen et al. | |
| 6,685,288 | B1 | 2/2004 | MacMillan | |
| 6,899,408 | B2 | 5/2005 | Chen et al. | |
| 6,938,967 | B2 | 9/2005 | Dubon et al. | |
| 7,083,243 | B2 | 8/2006 | Lee | |
| 7,104,691 | B2 | 9/2006 | Chi | |
| 7,111,913 | B2 | 9/2006 | Dubon | |
| 7,320,507 | B2 | 1/2008 | White et al. | |
| 7,347,515 | B1 | 3/2008 | Lu | |
| 7,347,516 | B2 | 3/2008 | Hay | |
| 7,364,245 | B2 | 4/2008 | Dubon | |
| 7,374,261 | B1 * | 5/2008 | Wang | A47B 88/0477 312/319.1 |
| 7,404,611 | B1 | 7/2008 | Que | |
| 7,441,848 | B2 | 10/2008 | Chen et al. | |
| 7,458,651 | B1 | 12/2008 | Radke et al. | |
| 7,520,577 | B2 | 4/2009 | Chen et al. | |
| 7,552,982 | B2 | 6/2009 | Beaudoin | |
| 7,641,296 | B2 | 1/2010 | Le | |
| 7,802,856 | B2 | 9/2010 | Hashemi et al. | |
| 7,854,485 | B2 | 12/2010 | Berger | |
| 7,857,403 | B2 | 12/2010 | Chen et al. | |
| 8,029,080 | B2 | 10/2011 | MacElveen | |
| 2003/0117048 | A1 | 6/2003 | Mueller | |
| 2003/0122460 | A1 | 7/2003 | Chang | |
| 2004/0197035 | A1 | 10/2004 | Doornbos et al. | |
| 2004/0201338 | A1 | 10/2004 | Mouw | |
| 2005/0248247 | A1 | 11/2005 | Huang | |
| 2007/0090735 | A1 * | 4/2007 | Hashemi | A47B 88/0477 312/334.46 |
| 2008/0197759 | A1 | 8/2008 | Chen et al. | |
| 2009/0115300 | A1 | 5/2009 | Chen et al. | |
| 2009/0189499 | A1 | 7/2009 | Yang | |
| 2010/0026152 | A1 | 2/2010 | Huang | |
| 2011/0007988 | A1 | 1/2011 | Huang | |
| 2011/0069914 | A1 | 3/2011 | Hashemi et al. | |
| 2011/0129172 | A1 | 6/2011 | Liang et al. | |
| 2011/0235952 | A1 | 9/2011 | Chen et al. | |
| 2012/0144622 | A1 | 6/2012 | Juan et al. | |
| 2013/0004101 | A1 * | 1/2013 | Chen | A47B 88/0477 384/10 |

FOREIGN PATENT DOCUMENTS

| | | |
|---|---|---|
| CN | 2764235 | 3/2006 |
| DE | 202004011916 | 12/2004 |
| DE | 202005003187 | 7/2005 |
| DE | 102004037120 | 3/2006 |
| DE | 102008004545 | 7/2009 |
| DE | 202009002715 | 8/2010 |
| DE | 202011000362 | 9/2011 |
| EP | 0743032 | 11/1996 |
| EP | 0766939 | 4/1997 |
| EP | 1634025 | 3/2006 |
| EP | 1716781 | 11/2006 |
| EP | 1925240 | 5/2008 |
| EP | 2007246 | 12/2008 |
| EP | 2201863 | 6/2010 |
| GB | 2416295 | 7/2005 |
| GB | 2434306 | 7/2007 |
| JP | 60215319 | 10/1985 |
| JP | 08-117044 | 5/1996 |
| JP | 2003204832 | 7/2003 |
| JP | 2004065701 | 4/2004 |
| JP | 2006102294 | 4/2006 |
| JP | 2007089680 | 4/2007 |
| JP | 2007190310 | 8/2007 |
| MY | 143065 | 2/2011 |
| TW | 281524 | 12/2005 |
| TW | 394046 | 12/2010 |
| TW | 396049 | 1/2011 |
| WO | 2004023933 | 3/2004 |
| WO | 2007050737 | 5/2007 |
| WO | 2007122066 | 11/2007 |
| WO | 2010009780 | 1/2010 |
| WO | 2010066393 | 6/2010 |
| WO | 2010123550 | 10/2010 |

* cited by examiner

PRESSURE RELEASE SLIDE LATCH MECHANISM

CROSS-REFERENCE TO RELATED APPLICATIONS

This application is a Continuation-In-Part of application Ser. No. 14/281,643, filed May 19, 2014, which is a Continuation-In-Part of application Ser. No. 13/460,197, filed Apr. 30, 2012, now abandoned. Each patent application identified above is incorporated here by reference in its entirety to provide continuity of disclosure.

FIELD OF THE DISCLOSURE

The present invention relates to slide assemblies for mounting drawers in cabinetry. In particular, the invention relates to extension ball bearing slide assemblies with a durable pressure release slide latch mechanism which retains the slide assembly in a closed position and opens upon exerting an inward force to release and open the slide assembly.

BACKGROUND OF THE DISCLOSURE

Drawer slide assemblies mounted to cabinets and drawers for slidably opening and closing a drawer are well known in the art. The assemblies typically include at least two slide rails that are telescopically mounted within one another to extend and retract. The typical assembly includes an outside rail, which is mounted to the cabinet and an inside rail, which is mounted to the drawer. Ball bearing assemblies are usually mounted between the rails to reduce the friction between the rails. This reduction in friction between the rails allows the drawer to easily open and close. As a result, the drawer can unintentionally open causing injury and/or causing the contents of the drawer to escape. For example, a child can easily pull open a drawer and strike a body part against the open drawer causing injury. In another example, a drawer mounted to a cabinet installed in a recreational vehicle can unintentionally open during movement causing the contents of the drawer to dislodge and escape.

The prior art has attempted to solve these problems. For example, U.S. Pat. No. 7,083,243 to Lee discloses a self-closing and opening-preventing device for slide rails. The device includes a housing mounted to the inside of a fixing rail attached to a cabinet. The housing has a central long pin guiding groove to accept a pin attached to a moveable rail. A cam slider moves within the housing and a spring is attached to the rear of the housing and to the cam slider. Engaging jaws mounted on the cam slider can be locked in the engaging holes. The engaging jaws are configured to receive an actuating pin fixed to a moveable rail to lock the opening-preventing device.

However, the device requires numerous parts that easily wear leading to failure of the device. Specifically, the spring remains in a stretched position until the engaging jaws engage the actuating pin. This constant tension leads to fatigue and premature failure. Further, the pins of the cam slider on which the engaging jaws are mounted are thin which leads to the severance of the pins from the cam slider.

U.S. Pat. No. 7,104,691 to Chi discloses a self-moving mechanism to keep a drawer slide in a closed position. The mechanism includes a housing mounted to a first slide rail, an actuator wader spring compression moveable within the housing wherein the movement of the actuator is guided by a series of slots, and an angled slit formed in the web of a second slide rail telescopically mounted to the first slide. As the second slide retracts, the angled slit engages a pin attached to the actuator and the actuator urges the pin and the second slide into a retracted position. Flexible tines adjacent a longitudinal slot keeps the pin of the actuator, and thereby the second slide, in a retracted position. The mechanism disclosed in Chi requires thin tines cut into a wall in the housing to keep the second slide in a retracted position, which leads to fatigue and ultimately failure. The premature failure renders the entire mechanism useless. Further, Chi does not provide a push to open feature.

U.S. Pat. No. 7,854,485 to Berger discloses a closing and opening device for drawers. A latch housing is attached to an outer rail and a moveable catch component slidably moves within the latch housing. The moveable catch component is moved by a dog attached to a running rail slidingly engaged with the outer rail and attached to a drawer. The moveable catch component is biased by a coupling rod adjacent to the moveable catch component and under spring compression. The coupling rod has a ball head to frictionally engage a receiver of the moveable catch component. Opposite the moveable catch component is a lever hingedly connected to the coupling rod. The lever has a projection that guides the lever along a cam path.

However, the device in Berger requires the ball head to frictionally engage the receiver of the moveable catch component each and every time the drawer is closed. Once the projection and lever is released from the closed position the ball head remains frictionally engaged with the moveable catch component requiring further pulling force to release the drawer. This constant frictional engagement between the ball head and the receiver leads to premature wear and ultimately failure, which results in rendering the opening and closing device useless.

The prior art fails to disclose or suggest a pressure release slide latch mechanism with a push to open feature that will not result in premature failure. Therefore, there is a need for a pressure release slide latch mechanism of durable construction allowing for a reliable and easy push to open feature with fewer parts. Anticipated applications of the invention include, but are not limited to environments where no drawer knobs or pull handles are desired, environments where safety is a concern such, and/or environments where sanitary conditions are a concern. For example, hospitals may use the invention to reduce the collection of bacteria on handles or knobs and daycare centers where the invention may be used reduce injury from striking protruding hardware and from the unintentional opening of a drawer.

SUMMARY OF THE DISCLOSURE

In a preferred embodiment, a pressure release slide latch mechanism for a drawer slide assembly comprises an outer slide member, an intermediate slide member telescopically mounted to the outer slide member, and an inner slide member telescopically mounted to the intermediate slide member. The preferred embodiment further comprises a channel plate having a track portion and a guide block attached to the outer slide member and a carriage slidingly engaged with the track portion of the channel plate. Two tension springs are attached to an end of the track portion and the carriage to bias the carriage. The guide block has a plurality of channels and a latch member to receive a pin of a follower pivotally attached to the inner slide member to releasably maintain the inner slide member and the intermediate slide member in a locked position with respect to the outer slide member. The pivotal movement of the follower is limited by a guide post connected to the follower and the engagement of the guide post with the inner slide member.

In use, to close the drawer slide assembly using the pressure release slide latch mechanism the intermediate slide member and the inner slide member approach a retracted position with respect to the outer slide member, the intermediate slide member engages the carriage and urges the carriage against the tension of the springs. Simultaneously, the inner slide member engages a set of bumpers on the carriage while the pin of the follower slidingly engages a ramp of the guide block and redirecting surfaces to guide the pin through an inlet channel and into a first positioning recess. Under spring bias from the springs attached to the channel plate and the carriage, the carriage extends the intermediate slide member and the inner slide member causing the pin to abut the latch member to retain the inner slide member and the intermediate slide member in a locked position with respect to the outer slide member.

To release the inner slide member and the intermediate slide member from the outer slide member, the inner slide member is urged against the tension of the springs to release the pin from the latch member and the pin is positioned by a redirecting surface into a second positioning recess. Under spring tension, the pin is allowed to travel through an outlet channel and engages redirecting surfaces to direct the pin out of the ramp to release the pin and thereby release the inner slide member and the intermediate slide member allowing the inner slide member and the intermediate slide member to telescopically extend with respect to the outer slide member.

BRIEF DESCRIPTION OF THE DRAWINGS

The disclosed embodiments will be described with reference to the accompanying drawings. Like pieces in different drawings carry the same number.

DETAILED DESCRIPTION

Figure 1A:
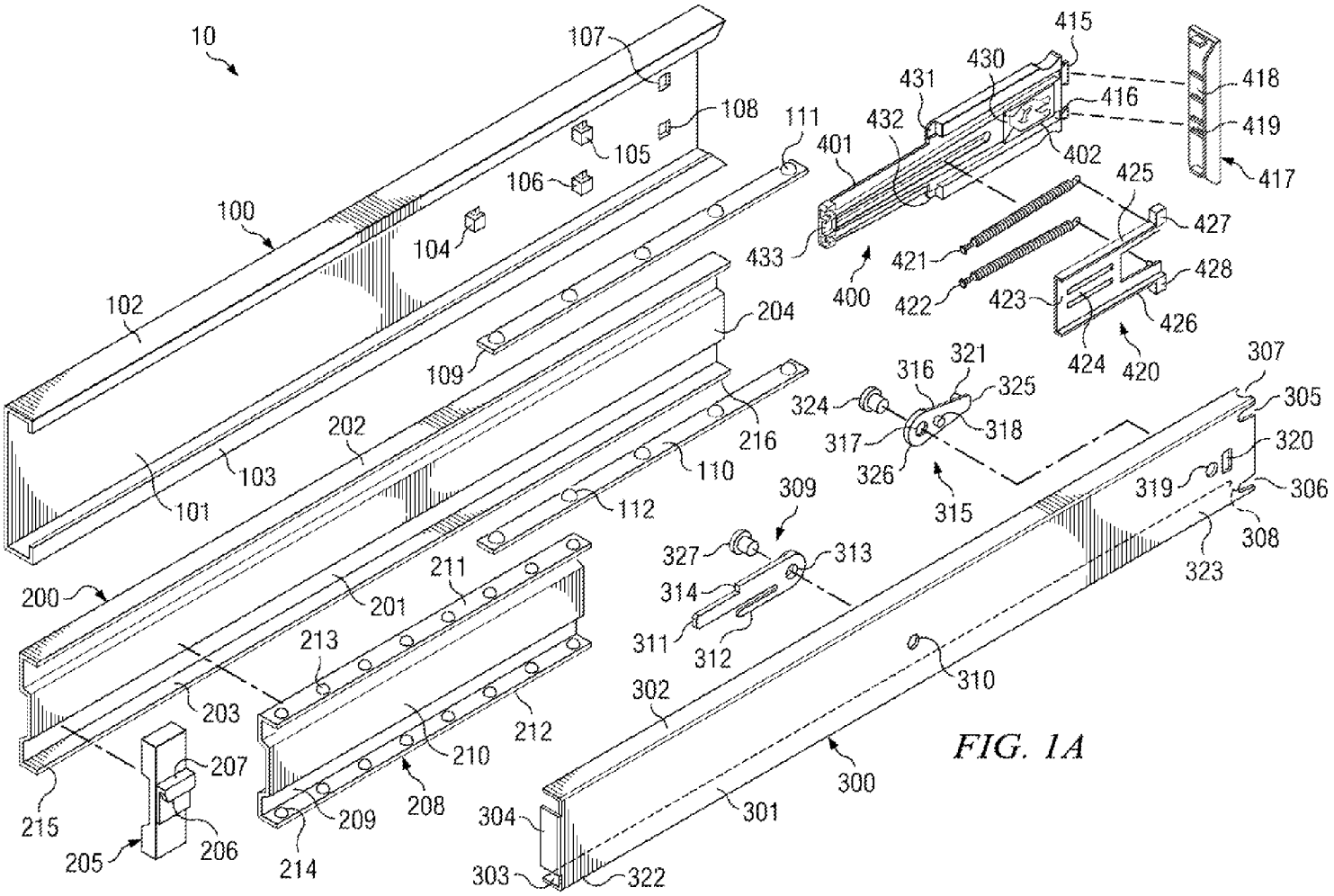
FIG. 1A is an exploded isometric view of a preferred embodiment.

Referring to FIG. 1A, drawer slide assembly 10 comprises outer slide member 100, intermediate slide member 200 telescopically mounted to outer slide member 100, and inner slide member 300 telescopically mounted to intermediate slide member 200. Outer slide member 100 has outer body portion 101 and opposing races 102 and 103 attached to outer body portion 101. Outer body portion 101 has catches 104, 105, and 106, and slots 107 and 108.

In a preferred embodiment, outer slide member 100 is made of a durable metal or metal alloy. Other durable materials known in the art may be used. Catches 104, 105, and 106 are raised portions of outer body portion 101 stamped into outer body portion 101 having a generally hooked shape. Slots 107 and 108 are generally rectangular holes cut out of outer body portion 101. Other shapes and structures known in the art may be employed to provide a fastening means.

Cage 109 telescopically slides into race 102. Cage 109 includes a plurality of ball bearings 111 inserted into holes in cage 109 and positioned along an inside surface of race 102. Cage 110 telescopically slides into race 103. Cage 110 includes a plurality of ball bearings 112 inserted into holes in cage 110 and positioned along an inside surface of race 103.

In a preferred embodiment, cages 109, 110, and ball bearings 111 and 112 are made of a durable metal or metal alloy. Other durable materials known in the art may be used.

Intermediate slide member 200 telescopically mounts to outer slide member 100 with cages 109 and 110 positioned between intermediate slide member 200 and outer slide member 100. An outside surface of race 202 is adjacent ball bearings 111 of cage 109. An outside surface of race 203 is adjacent ball bearings 112 of cage 110. Intermediate slide member 200 has intermediate body portion 201 and opposing races 202 and 203 attached to intermediate body portion 201, end 215, and end 216. Intermediate body portion 201 has ridge 204 formed into intermediate body portion 201 and extends longitudinally and generally centrally along intermediate body portion 201.

In a preferred embodiment, intermediate slide member 200 is made of a durable metal or metal alloy. Other durable materials known in the art may be used. Ridge 204 is a stamped portion of intermediate body portion 201. Other structures known in the art may be employed to form ridge 204.

Intermediate stop 205 attaches to intermediate slide member 200 at end 215. Intermediate stop 205 has stop ridge 206 and stop catch 207. Intermediate stop 205 has a cross-sectional shape similar to that of intermediate slide member 200 enabling intermediate stop 205 to press-fit into intermediate slide member 200 at end 215 and conform to the cross-sectional shape of intermediate slide member 200. Other means of attachment known in the art may be employed.

In a preferred embodiment, intermediate stop 205 is made of a single piece of durable plastic. Other durable materials known in the art may be used.

Bearing retainer 208 telescopically inserts into intermediate slide member 200. Bearing retainer 208 has retainer body portion 209 and opposing cages 211 and 212 attached to retainer body portion 209. Retainer body portion 209 has retainer ridge 210 formed into retainer body portion 209 and extends longitudinally and generally centrally along retainer body portion 209. Cage 211 has a plurality of ball bearings 213 inserted into holes in cage 211. Cage 212 has a plurality of ball bearings 214 inserted into holes in cage 212.

In a preferred embodiment, bearing retainer 208, cages 211, 212, and ball bearings 213 and 214 are made of a durable metal or metal alloy. Other durable materials known in the art may be used. In this embodiment, retainer ridge 210 is a stamped portion of retainer body portion 209. Other structures known in the art may be employed to form retainer ridge 210.

Inner slide member 300 telescopically mounts to intermediate slide member 200 with bearing retainer 208 positioned between inner slide member 300 and intermediate slide member 200. Inner slide member 300 has inner body portion 301, opposing races 302 and 303, end 322, and end 323. End stop 304 is attached to inner body portion 301 at end 322. Inner body portion 301 has recesses 305 and 306 at end 323. Inner body portion 301 further has hole 310 through which fastener 327 is received, hole 319 through which fastener 324 is received, and guide slot 320. Race 302 has race slot 307 at end 323. Race 303 has race slot 308 at end 323.

In a preferred embodiment, inner slide member 300 is made of a durable metal or metal alloy. Other durable materials known in the art may be used. In this embodiment, guide slot 320 is generally rectangular in shape. In another embodiment, guide slot 320 is generally arcuate in shape. Other shapes will suffice.

Follower 315 pivotally connects to inner slide member 300 with fastener 324 inserted through hole 319. Follower 315 includes follower body 316. Follower body 316 has end 325, end 326, and pivot hole 317 at end 326 through which fastener 324 is inserted. Guide post 318 attaches to follower body 316 between end 325 and end 326 and extends generally perpendicularly from follower body 316 into guide slot 320 of inner body portion 301. Pin 321 attaches to follower body 316 at end 325 and extends generally perpendicularly from follower body 316 away from inner body portion 301.

In a preferred embodiment, follower 315 is formed of a single piece of plastic such as Delrin® and Teflon®. Other durable materials, including other plastics, metals and metal alloys, may be used. In this embodiment, fastener 324, is a flush rivet. Other suitable fasteners known in the art may be employed.

Latch 309 pivotally connects to inner body portion 301 with fastener 327 through hole 310. Latch 309 has latch handle 311, resilient member 312, shoulder 314, and hole 313, sized to receive fastener 327. Resilient member 312 urges shoulder 314 towards race 302. Shoulder 314 engages stop catch 207 of intermediate stop 205 to prevent disengagement of inner slide member 300 from intermediate slide member 200.

In a preferred embodiment, latch 309 is formed of a single piece of plastic such as Delrin® and Teflon®. Other durable materials, including other plastics, metals and metal alloys, may be used. In this embodiment, fastener 327, is a flush rivet. Other suitable fasteners known in the art may be employed.

Figure 1B:
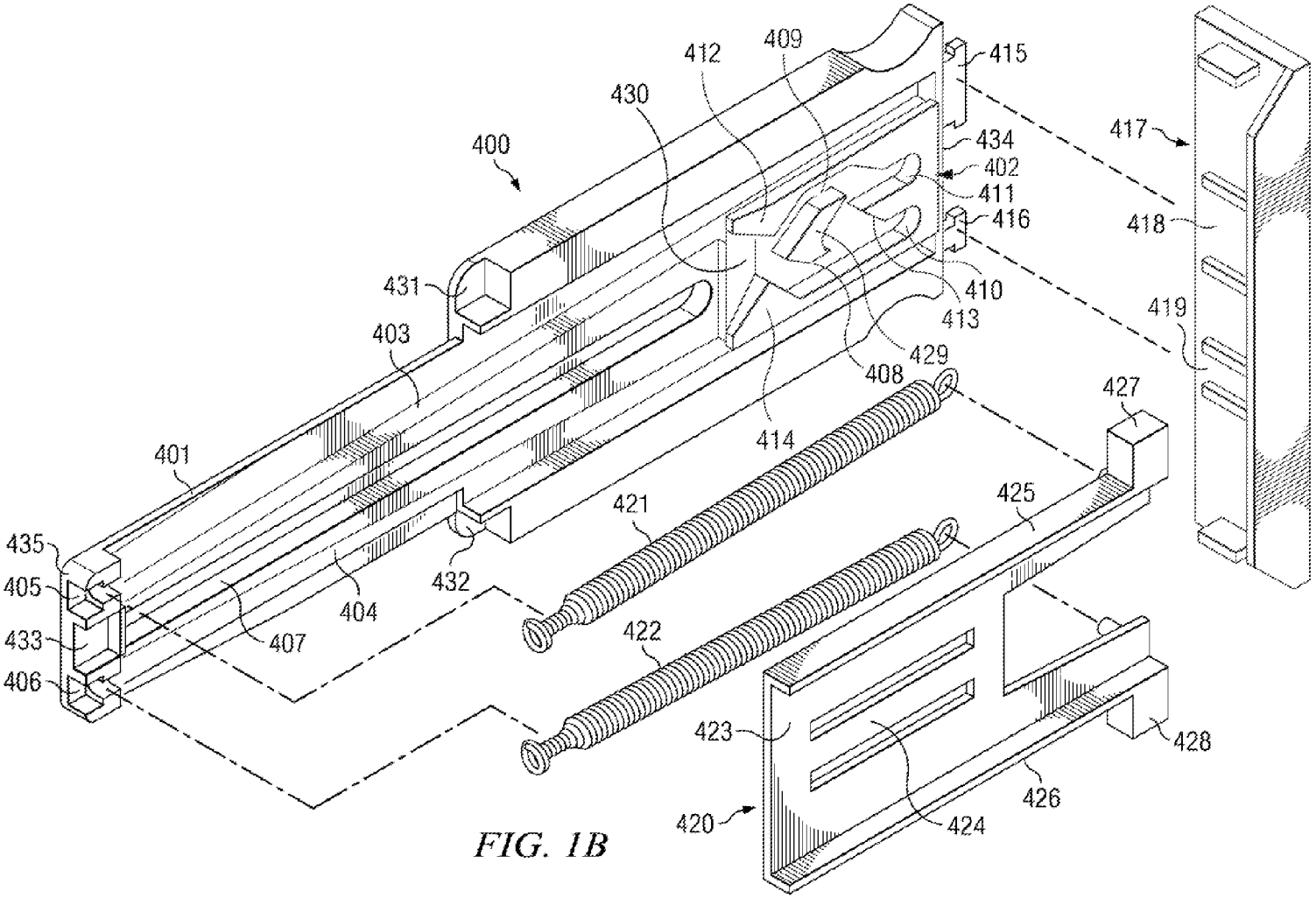
FIG. 1B is a detail view of a pressure release slide latch mechanism of a preferred embodiment.

Referring to FIG. 1B, channel plate 400 attaches to outer slide member 100. Channel plate 400 has track portion 401 and guide block 402. Guide block 402 is adjacent to track portion 401 and end 434. Track portion 401 has catch surfaces 431, 432, and 433 that frictionally engage with catches 104, 105, and 106 of outer body portion 101. Carriage track 407 is adjacent catch surface 433 and extends generally centrally and longitudinally along track portion 401. Spring guides 403 and 404 are each positioned on each side of carriage track 407 immediately adjacent to catch surface 433 at end 435, extend beside carriage track 407 increasing in distance from a central axis of carriage track 407, and extend between guide block 402 and outer body portion 101 to a distance approximately greater than the width of guide block 402 at end 434. Spring guide 403 has spring hold 405 adjacent catch surface 433 to secure spring 421. Spring guide 404 has spring hold 406 adjacent catch surface 433 to secure spring 422.

Carriage 420 slidingly engages with track portion 401. Carriage 420 has frame 423, extension 425, and extension 426. Frame 423 has rail 424 extending generally centrally and longitudinally along frame 423 to slidingly engage with carriage track 407. Extension 425 has bumper 427 to which spring 421 is further attached. Extension 426 has bumper 428 to which spring 422 is further attached. The attachment of springs 421 and 422 to track portion 401 and carriage 420 biases carriage 420 along track portion 401 towards end 435.

Guide block 402 has ramp 430, inlet shoulder 412, inlet channel 409, positioning recess 411, latch member 429, redirecting surface 413, positioning recess 410, outlet channel 408, and outlet shoulder 414. Lugs 415 and 416 extend from end 434 adjacent guide block 402. Lugs 415 and 416 frictionally engage with slots 418 and 419, respectively, of base 417. Base 417 frictionally engages with the ends of races 102 and 103 of outer slide member 100 to further secure channel plate 400 to outer slide member 100.

In a preferred embodiment, channel plate 400, carriage 420, and base 417 are made of plastic. Other durable materials, including metals and metal alloys, may be used. In this embodiment, springs 421 and 422 are coil tension springs. Other resilient materials known in the art including, but not limited to elastic rubber bands may be employed. Other resilient biasing means known in the art may be employed including, but not limited to compression springs, elastomeric materials such as neoprene, fluid-filled piston/cylinder arrangements, and combinations thereof positioned in spring guide 403 and/or spring guide 404 at end 434 to urge carriage 420 towards end 435 will suffice.

Figure 2:
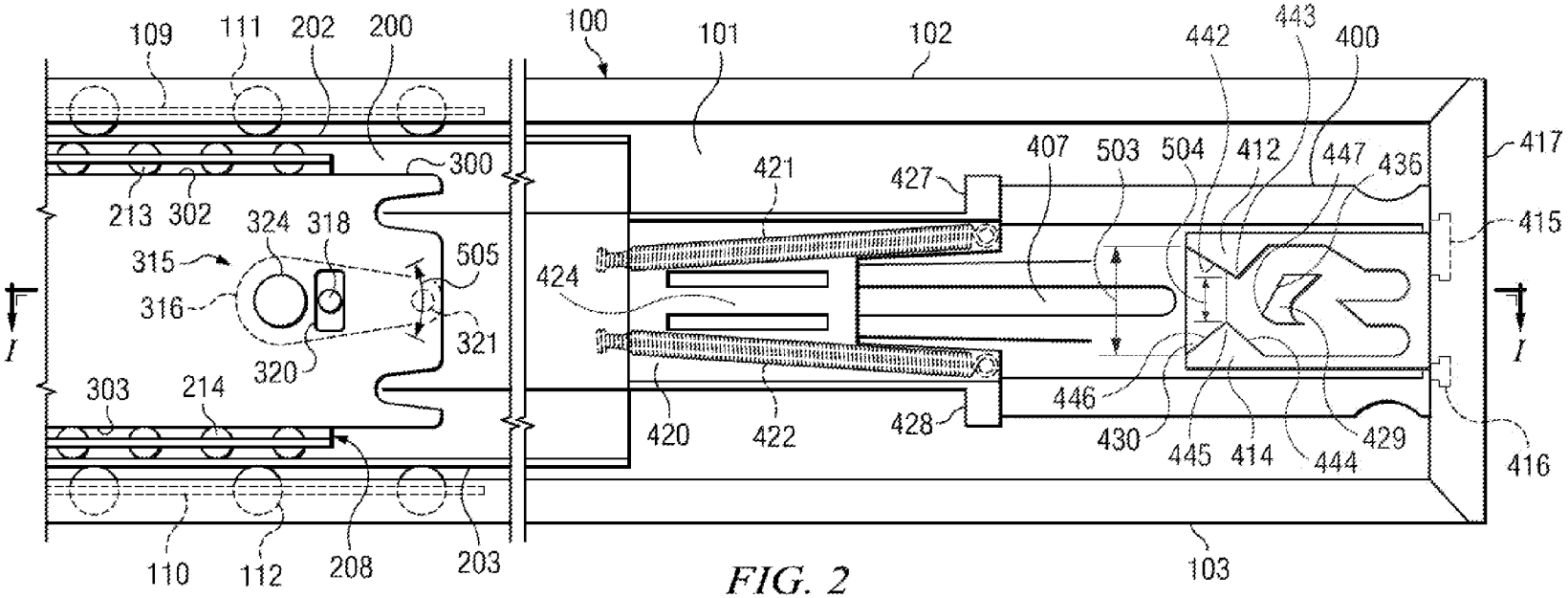
FIG. 2 is an assembled side view of a preferred embodiment.

Referring to FIG. 2, cage 109 inserts into race 102 of outer slide member 100 and ball bearings 111 are positioned in race 102 to roll within race 102 and along the outside surface of race 202 of intermediate slide member 200. Cage 110 inserts into race 103 of outer slide member 100 and ball bearings 112 are positioned in race 103 to roll within race 103 and along the outside surface of race 203 of intermediate slide member 200.

Bearing retainer 208 inserts into intermediate slide member 200 such that ball bearings 213 position between inside surface of race 202 and the outside surface of race 302 of inner slide member 300, and ball bearings 214 position between inside surface of race 203 and the outside surface of race 303 of inner slide member 300.

Ramp 430 has a generally trapezoidal shape with width 503 and width 504. Width 503 is greater than width 504. Inlet shoulder 412 includes redirecting surface 442 and peak 443. Outlet shoulder 414 includes redirecting surface 444, peak 445, and redirecting surface 446. Peaks 443 and 445 are offset such that peak 443 is closer to end 434 than peak 445. Peak 445 coincides with an edge of ramp 430. Latch member 429 includes peak 447 and redirecting surface 436.

Follower 315 pivotally attaches to inner slide member 300 with fastener 324. Follower 315 pivots about the central axis of fastener 324. The connection of follower 315 to inner slide member 300 is such that frictional forces keep the position of follower 315 relative to inner slide member 300 static and prevent follower 315 from freely rotating unless acted upon by a redirecting surface. The pivotal range of movement of follower 315 is limited by the sliding engagement of guide post 318 with guide slot 320. As follower 315 pivots, guide slot 320 has dimensions which restrict pin 321 to swing through arcuate path 505. Arcuate path 505 is less than width 503 to consistently direct pin 321 into guide block 402 via ramp 430 regardless of the position of follower 315.

Figure 3:
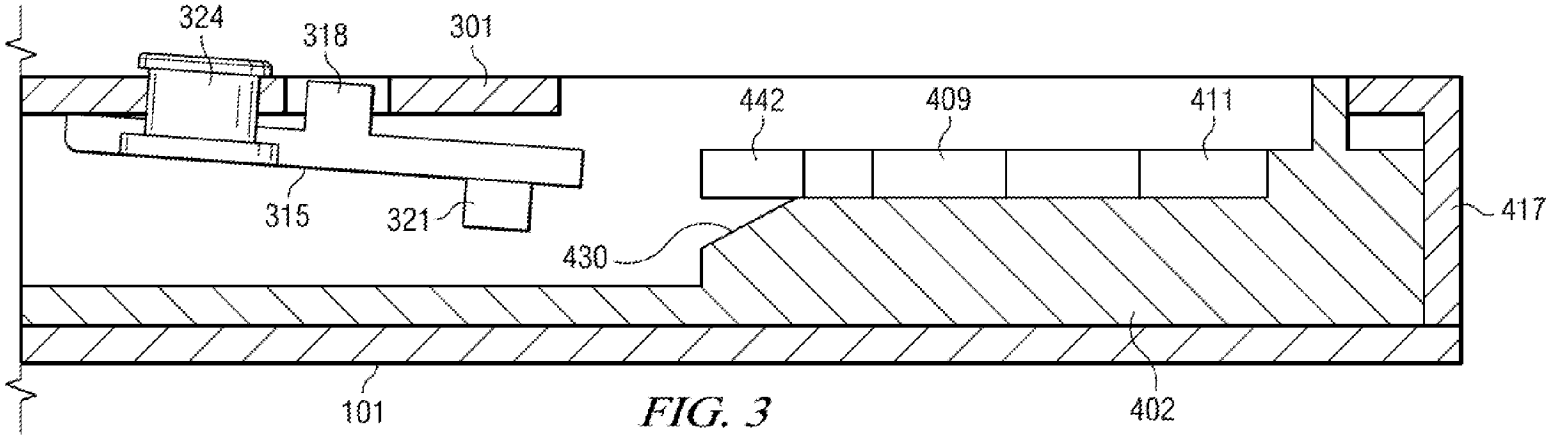
FIG. 3 is a partial section view of a guide block of a preferred embodiment taken along line I-I of FIG. 2.
Figure 4:
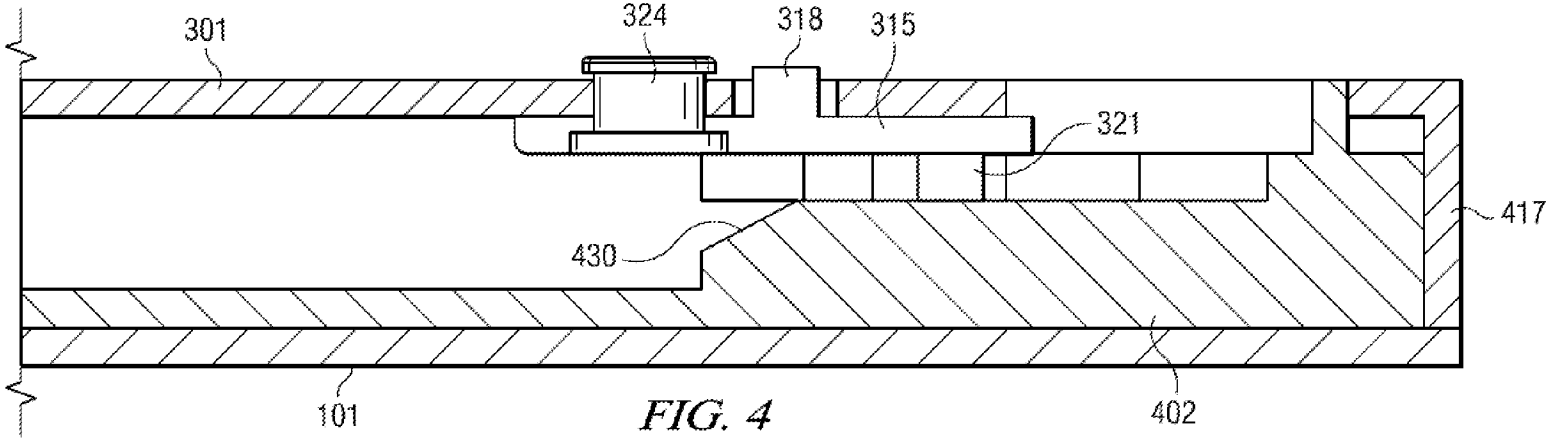
FIG. 4 is a partial section view of a guide block engaged with a follower of a preferred embodiment taken along line I-I of FIG. 2.

Referring to FIGS. 3 and 4, ramp 430 is angled with respect to outer body portion 101 and inner body portion 301 to consistently direct pin 321 into guide block 402. Ramp 430 is angled to provide consistent operation during possible deflection of drawer slide assembly 10. In normal operation, follower 315 is adjacent to and generally parallel with inner body portion 301. As shown in FIG. 3, in a case in which follower 315 separates from inner slide 300, but remains loosely fastened to inner slide member 300, pin 321 will slidingly engage ramp 430. As shown in FIG. 4, ramp 430 forces follower 315 back adjacent to and generally parallel with inner slide member 301 thereby correctly positioning pin 321 between redirecting surfaces 442 and 446 and prevents jamming.

Figure 5A:
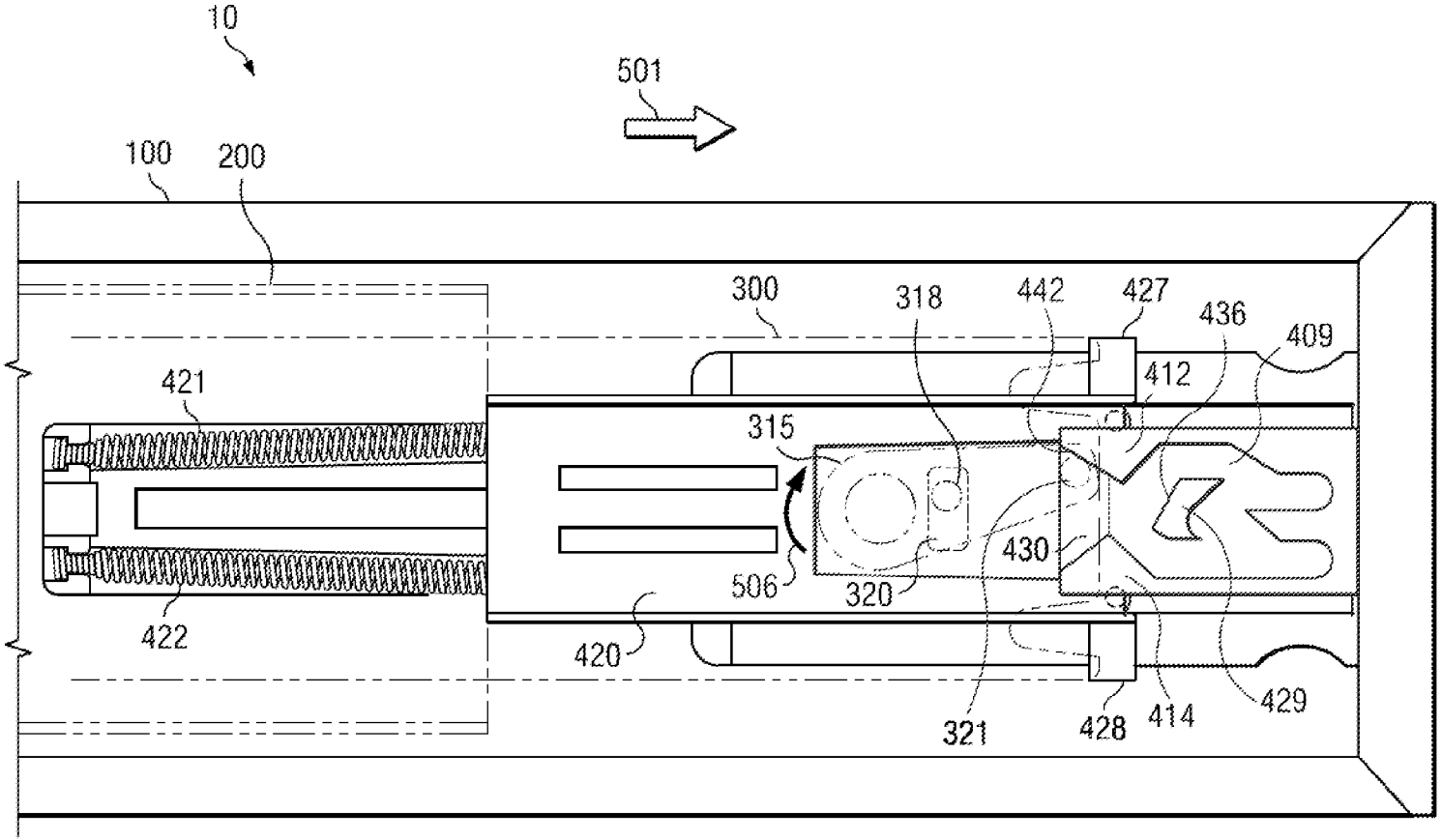
FIG. 5A is a side view of a follower approaching a guide block of a preferred embodiment.
Figure 5B:
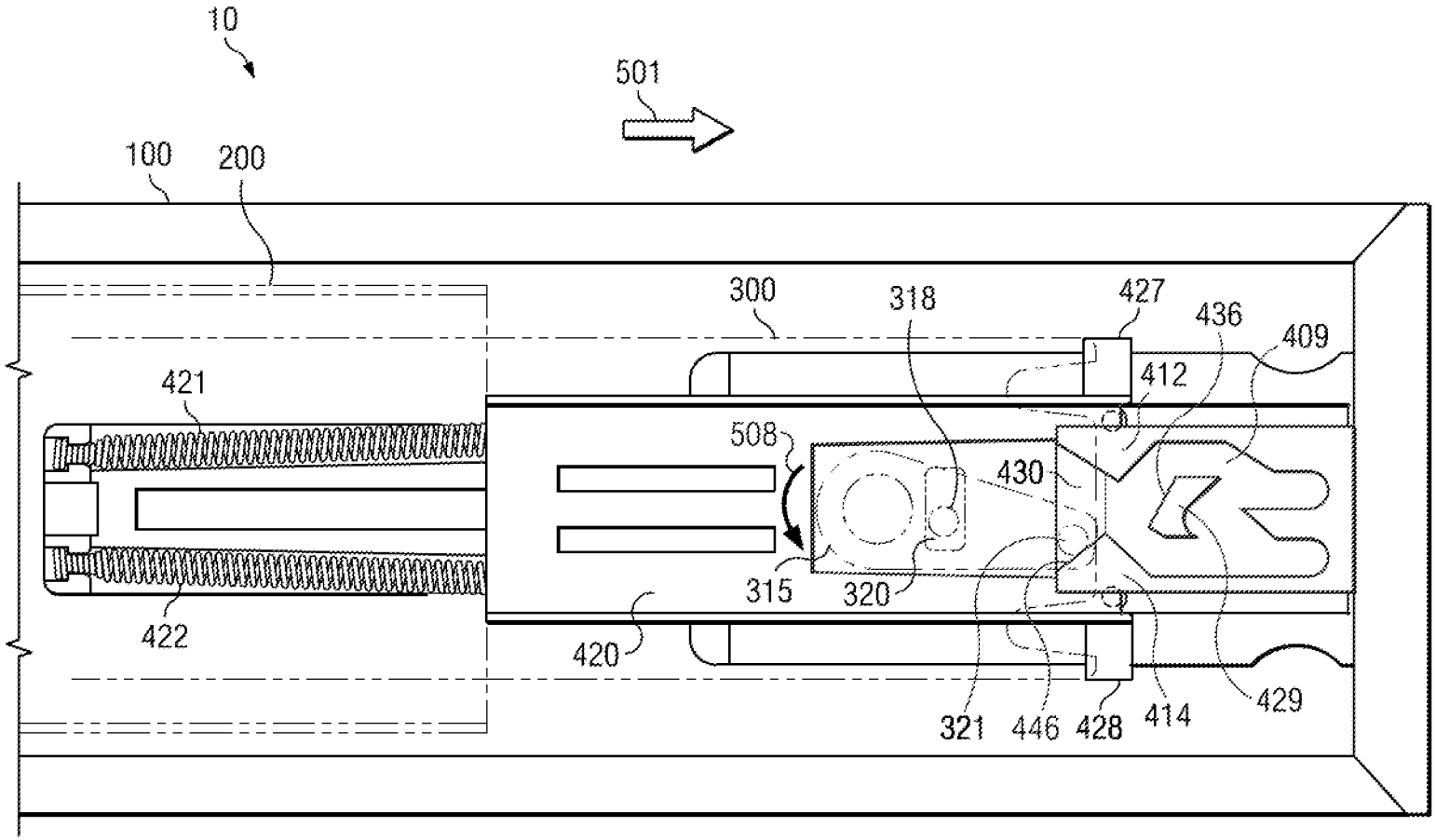
FIG. 5B is a side view of a follower approaching a guide block of a preferred embodiment.
Figure 5C:
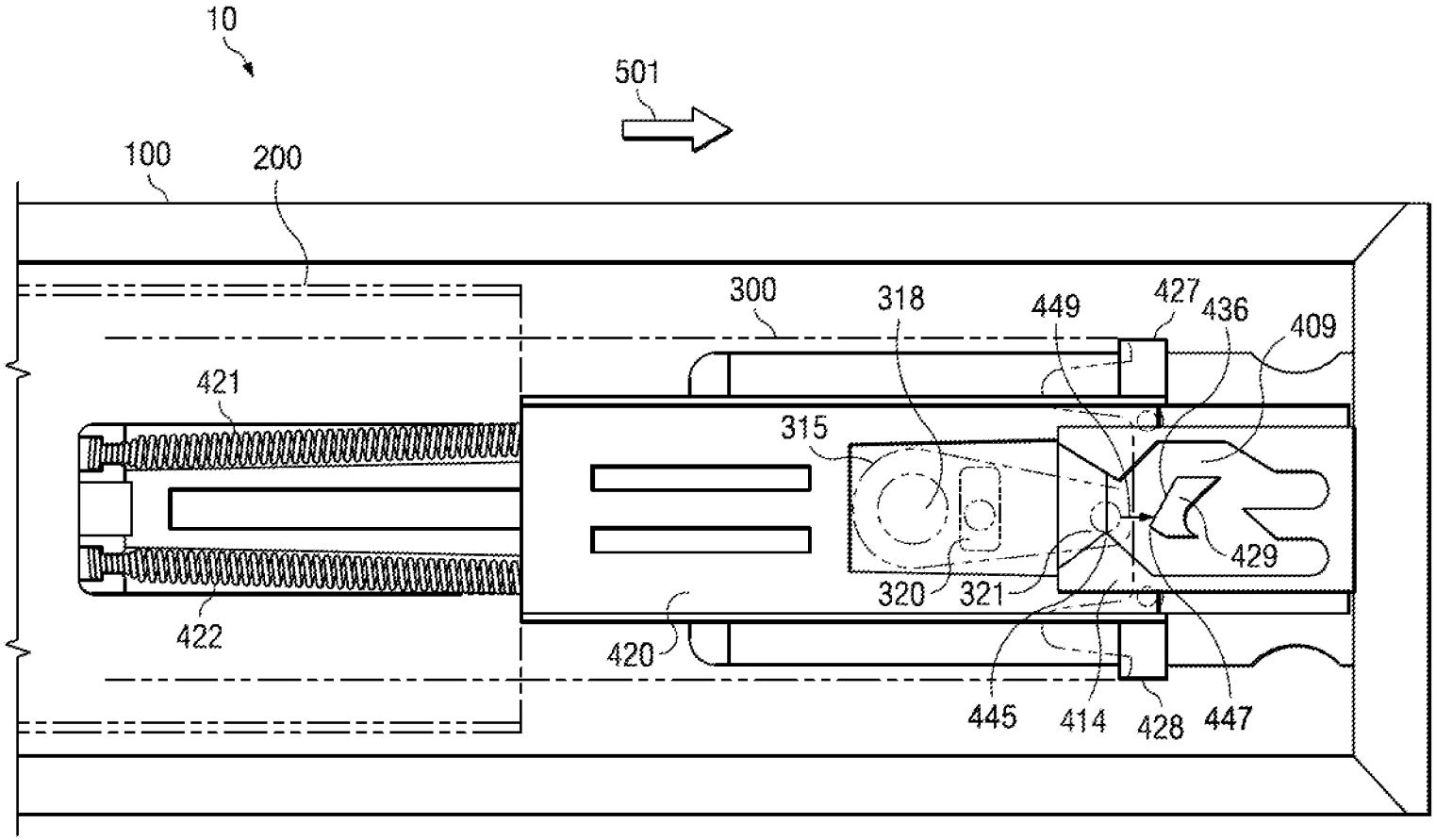
FIG. 5C is a side view of a follower after entering a guide block of a preferred embodiment.

Referring to FIGS. 5A-5C, to close drawer slide assembly 10, inner slide member 300 and intermediate slide member 200 move in proximal direction 501. Intermediate slide member 200 abuts carriage 420. Inner slide member 300 engages bumpers 427 and 428 and urges carriage 420 in proximal direction 501 against the bias of springs 421 and 422. Pin 321 may potentially be positioned anywhere along arcuate path 505. As pin 321 slidingly engages ramp 430, either redirecting surface 442 or redirecting surface 446 will cause follower 315 to pivot about the central axis of fastener 324 and position pin 321 towards engagement with redirecting surface 436.

FIG. 5A shows pin 321 contacting redirecting surface 442 resulting in follower 315 pivoting in direction 506.

FIG. 5B shows pin 321 contacting redirecting surface 446 resulting in follower 315 pivoting in direction 508. As pin 321 is positioned to engage redirecting surface 436, guide post 318 is located generally centrally in guide slot 320. As inner slide member 300 and intermediate slide member 200 continue to move in proximal direction 501, pin 321 engages redirecting surface 436 and redirects pin 321 into inlet channel 409.

FIG. 5C shows pin 321 cresting peak 445 after engaging redirecting surface 436. As follower 315 continues to move in proximal direction 501, linear path 449 tracks the center point of pin 321. The dimensions of outlet shoulder 414, including peak 445, and pin 321 ensure that as pin 321 passes peak 445, linear path 449 is always positioned above (as relationally laid out on the page shown in FIG. 5C) peak 447 such that pin 321 is always directed towards contact with redirecting surface 436 when follower 315 is moving in proximal direction 501.

Figure 6:
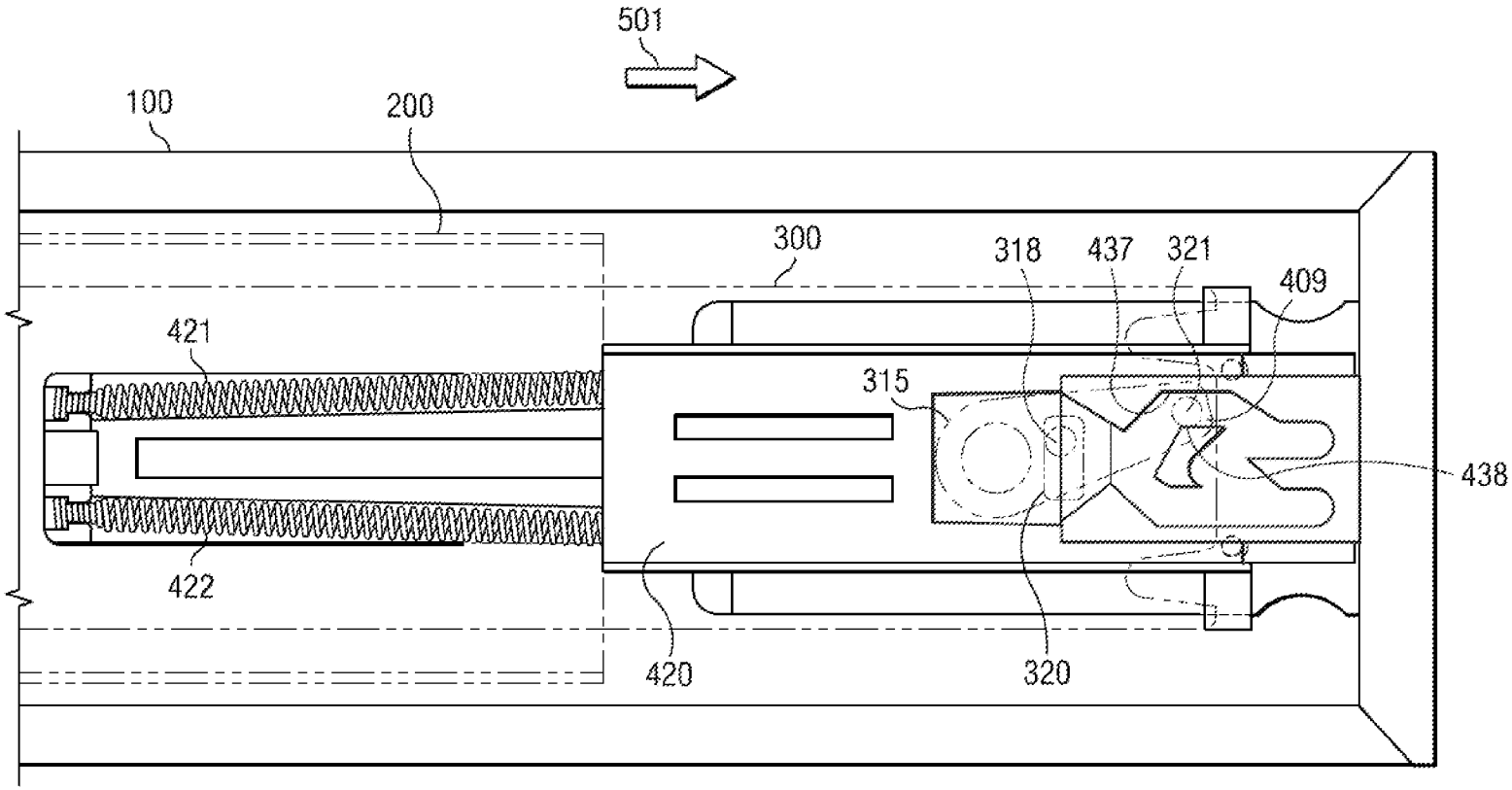
FIG. 6 is a side view of a follower engaged with an inlet channel of a guide block of a preferred embodiment.

Referring to FIG. 6, as inner slide member 300 and intermediate slide member 200 further urge carriage 420 in proximal direction 501 against the bias of springs 421 and 422, pin 321 is directed into inlet channel 409 between redirecting surfaces 437 and 438 thereby pivoting follower 315 and moving guide post 318 to a first end of guide slot 320.

Figure 7:
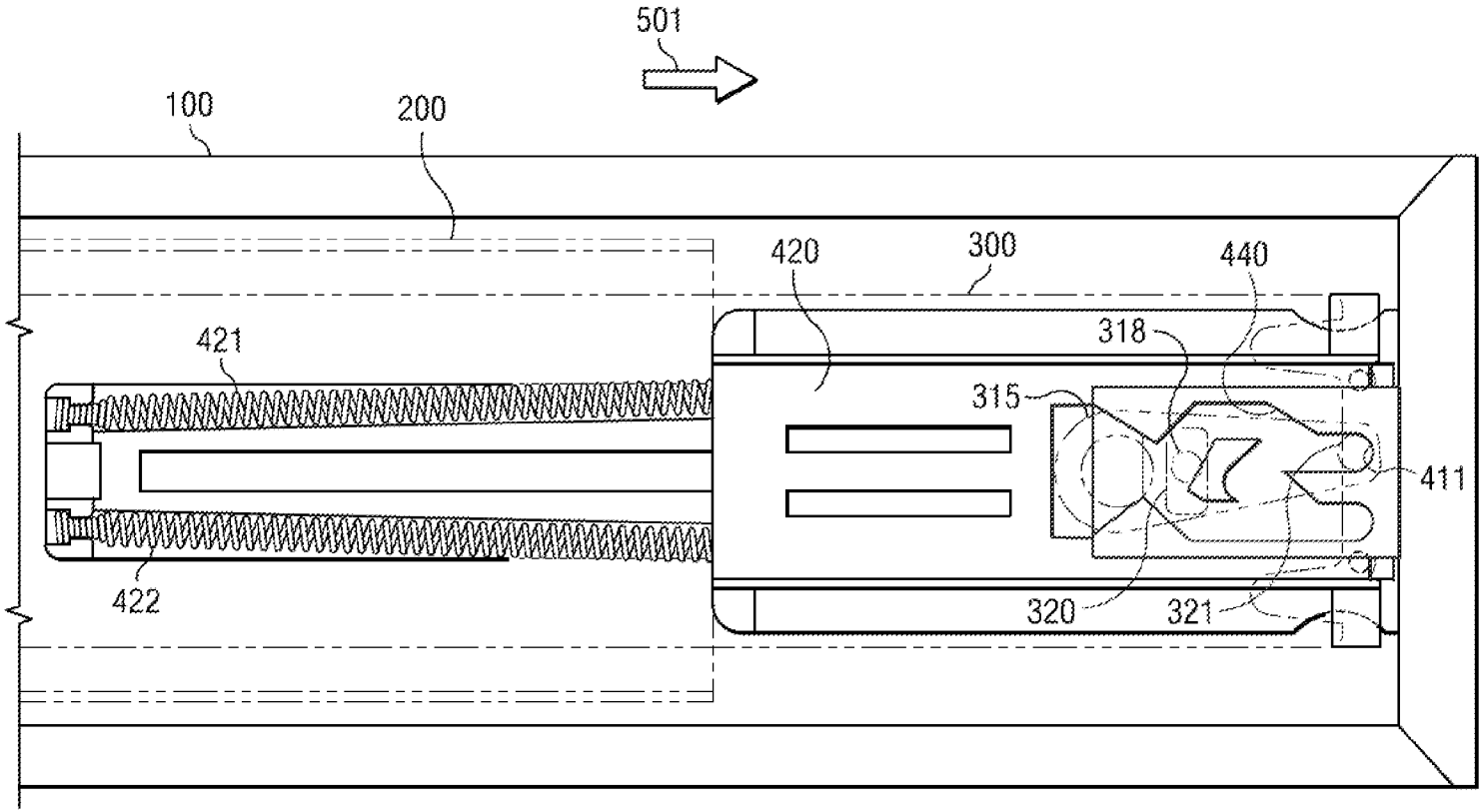
FIG. 7 is a side view of a follower engaged with a positioning recess of a guide block of a preferred embodiment.

Referring to FIG. 7, as inner slide member 300 and intermediate slide member 200 further urge carriage 420 in proximal direction 501 against the bias of springs 421 and 422, pin 321 is redirected into positioning recess 411 by redirecting surface 440. Follower 315 pivots away from the first end of guide slot 320 towards the center of guide slot 320.

Figure 8:
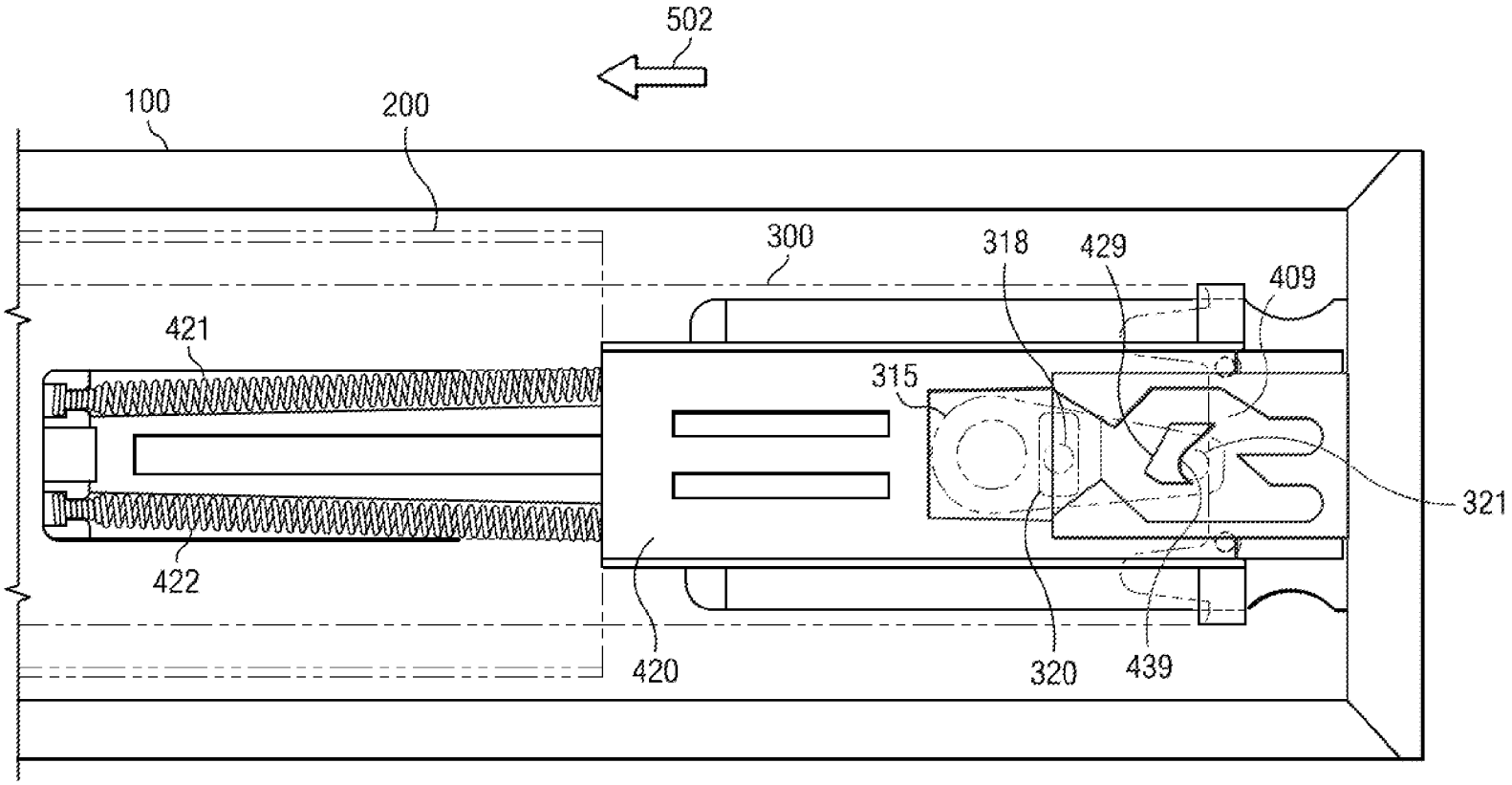
FIG. 8 is a side view of a follower engaged with a catch surface of a guide block of a preferred embodiment.

Referring to FIG. 8, inner slide member 300 and intermediate slide member 200 are urged in distal direction 502 by the bias of springs 421 and 422 until pin 321 engages latch surface 439. The bias of intermediate slide member 200, inner slide member 300, and thereby pin 321 against latch member 429 by springs 421 and 422, releasably maintains inner slide member 300 and intermediate slide member 200 in a closed retracted position with respect to outer slide member 100.

Figure 9:
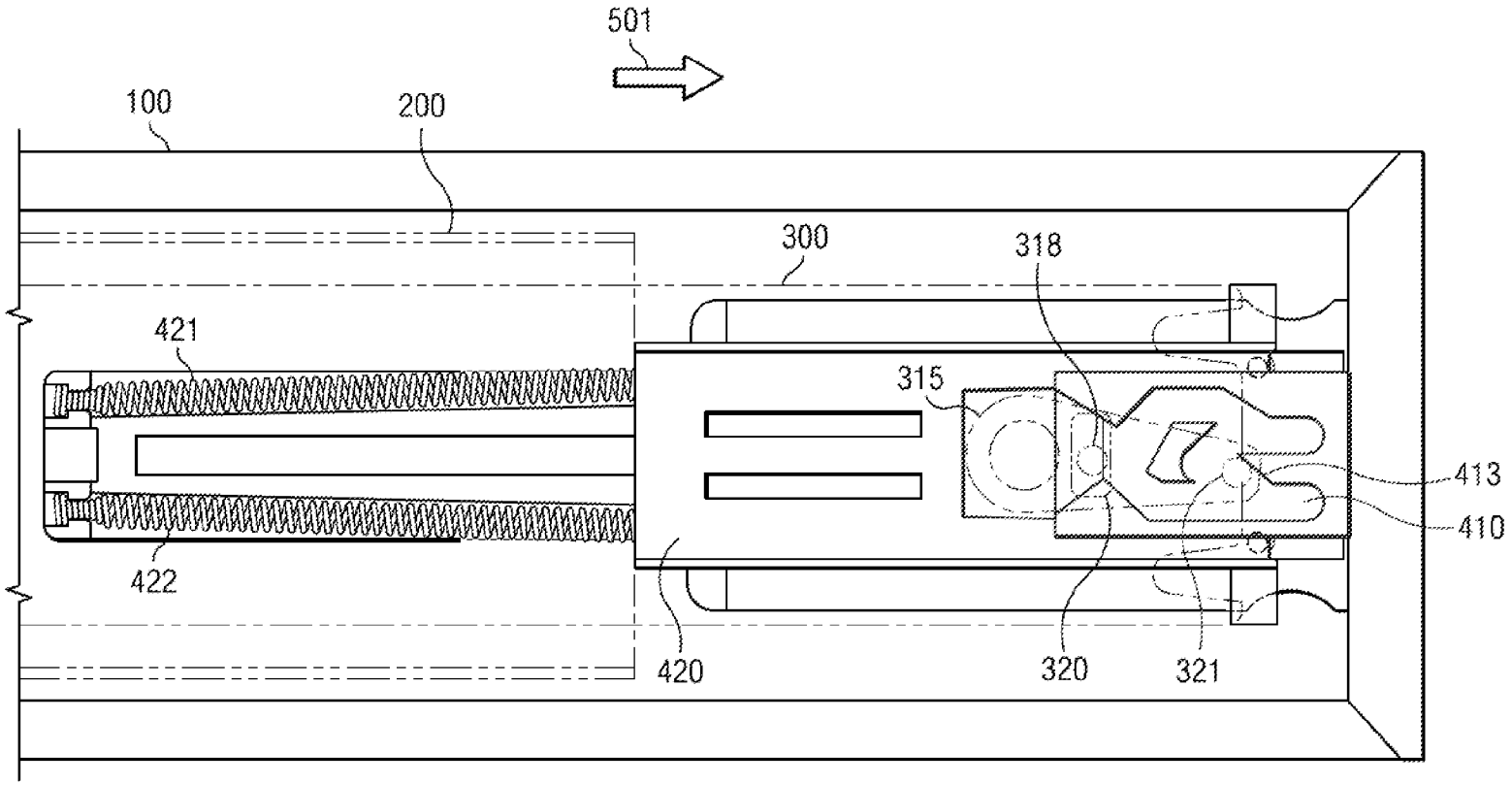
FIG. 9 is a side view of a follower engaged with a redirecting surface of a guide block of a preferred embodiment.

Referring to FIG. 9, to release inner slide member 300 and intermediate slide member 200, inner slide member 300 and intermediate slide member 200 move in proximal direction 501 and urge carriage 420 against the bias of springs 421 and 422 and away from latch member 429. Pin 321 engages redirecting surface 413 to direct pin 321 towards positioning recess 410. Follower 315 pivots towards positioning recess 410 and guide post 318 slides towards a second end of guide slot 320.

Figure 10:
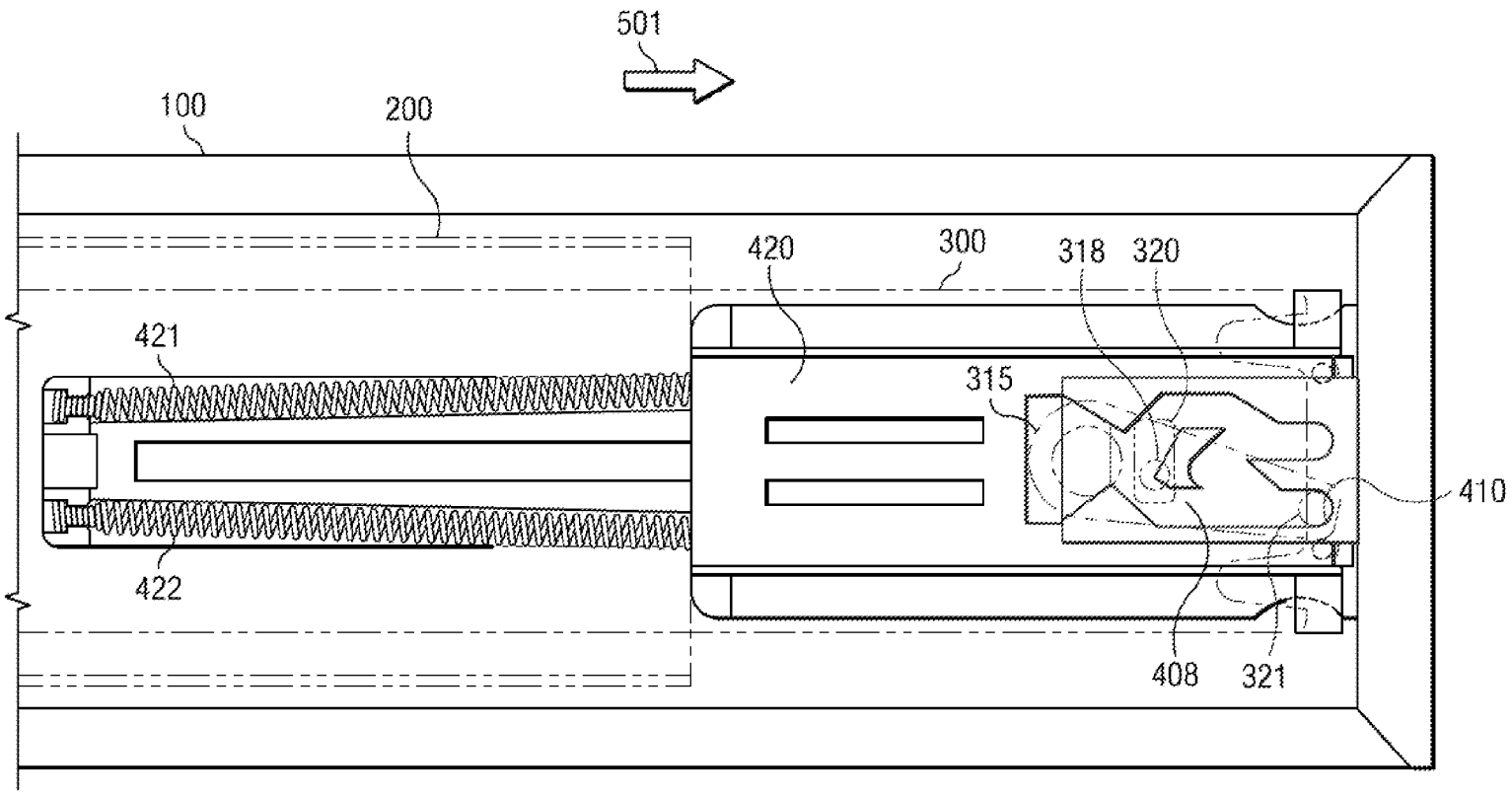
FIG. 10 is a side view of a follower engaged with a positioning recess of a guide block of a preferred embodiment.

Referring to FIG. 10, inner slide member 300 and intermediate slide member 200 further move in proximal direction 501 and urge carriage 420 against the bias of springs 421 and 422. Pin 321 situates in positioning recess 410. Follower 315 pivots towards positioning recess 410 and guide post 318 slides to the second end of guide slot 320. From positioning recess 410, pin 321 can now move into outlet channel 408.

Figure 11:
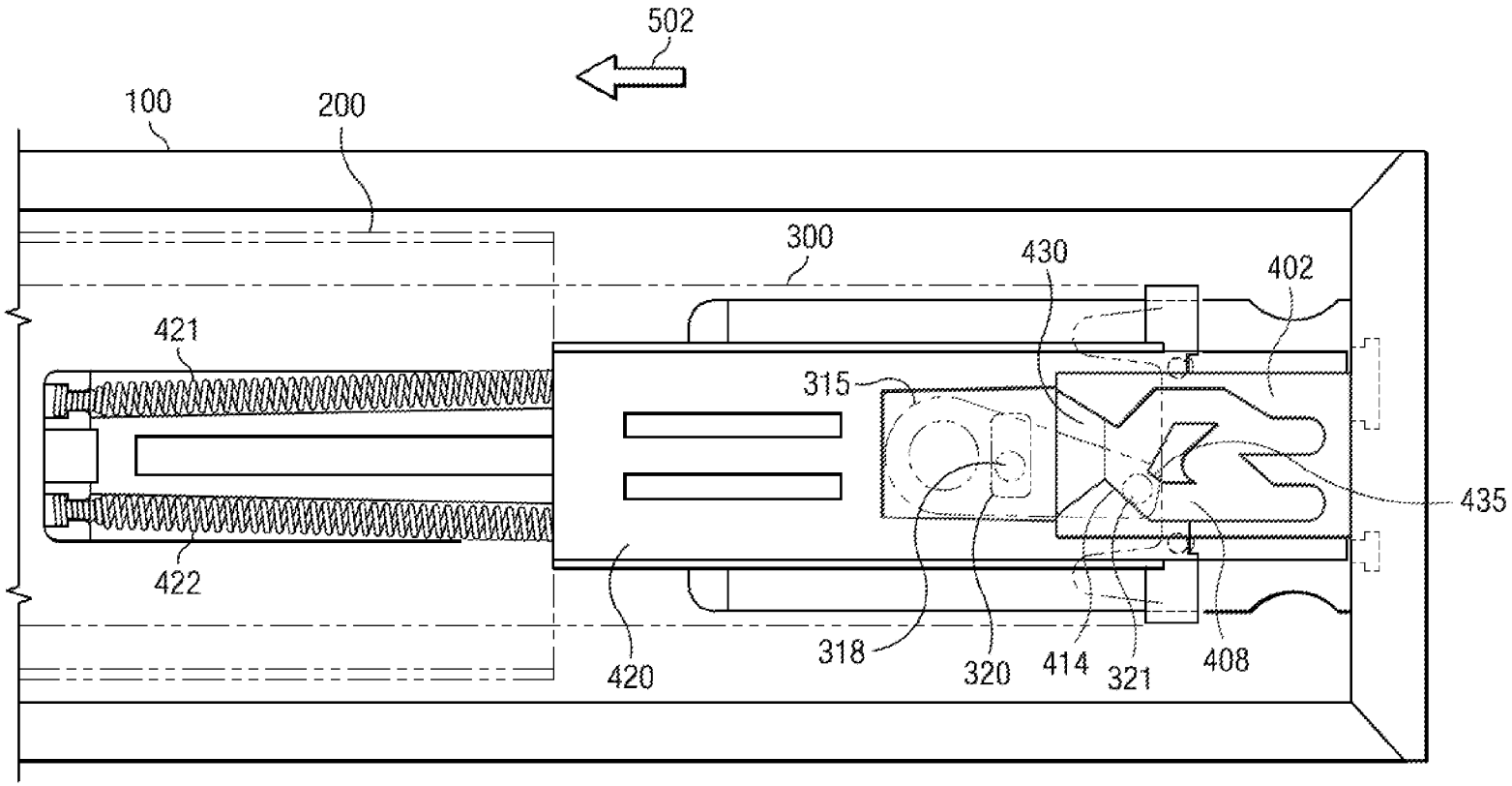
FIG. 11 is a side view of a follower engaged with a redirecting surface of a guide block of a preferred embodiment.

Referring to FIG. 11, inner slide member 300 and intermediate slide member 200 move under the bias of springs 421 and 422 in distal direction 502. The frictional forces from the connection of follower 315 to inner slide member 300 hold the position of follower 315 and pin 321 static and prevent follower 315 and pin 321 from moving relative to inner slide member 300. Pin 321 moves through outlet channel 408 and engages redirecting surface 444. Redirecting surface 444 directs pin 321 towards ramp 430 to exit guide block 402. The redirection of pin 321 by redirecting surface 444 pivots follower 315 back to a generally central position thereby releasing inner slide member 300 and intermediate slide 200 allowing inner slide member 300 and intermediate slide 200 to extend with respect to outer slide member 100 and positioning follower 315 for possible future engagement with ramp 430.

It will be appreciated by those skilled in the art that modifications can be made to the embodiments disclosed and remain within the inventive concept. Therefore, this invention is not limited to the specific embodiments disclosed, but is intended to cover changes within the scope and spirit of the claims.

The invention claimed is:

1. A pressure release slide latch mechanism for a drawer slide assembly comprising:

an outer slide member;

an intermediate slide member telescopically mounted to the outer slide member;

an inner slide member having a guide slot, telescopically mounted to the intermediate slide member;

a follower having a range of entry positions and pivotally connected to the inner slide member, the follower comprising a pin and a guide post slidingly engaged with the guide slot;

a channel plate having a track and a guide block, connected to the outer slide member, where an entrance to the guide block includes a first redirecting surface and a second redirecting surface;

the guide block further comprising:

an inlet shoulder, having an inlet peak, defining the first redirecting surface;

an outlet shoulder, having an outlet peak, defining the second redirecting surface;

an inlet channel adjacent the inlet peak and the first redirecting surface; and, an outlet channel adjacent the outlet peak and the second redirecting surface;

a carriage slidingly engaged with the track;

a biasing means, creating a bias between the carriage and the channel plate;

whereby the inner slide member and the intermediate slide member are releasably maintained in a locked position with respect to the outer slide member by the follower engaging the guide block against the bias and released upon a proximal force applied to the inner slide member, thereby disengaging the follower from the guide block.

2. The pressure release slide latch mechanism of claim 1, wherein the guide block further comprises:

a ramp adjacent the inlet channel and the outlet channel;

a plurality of redirecting surfaces adjacent the inlet channel and the outlet channel;

a latch member adjacent the inlet channel and the outlet channel; and wherein the plurality of redirecting surfaces and the latch member define the inlet channel and the outlet channel.

3. The pressure release slide latch mechanism of claim 2 further comprising:

where the inlet shoulder and the outlet shoulder are adjacent the ramp; and, whereby the guide slot and the guide post limit a pivotal movement of the follower.

4. The pressure release slide latch mechanism of claim 1, wherein a set of dimensions of the guide slot limit an arcuate path through which the follower pivotally moves thereby enabling the pin to consistently engage the entrance.

5. A drawer slide assembly for mounting a drawer to a cabinet comprising:

a first slide;

a second slide, engaging the first slide;

a third slide, engaging the second slide;

a pressure release mechanism, attached to the first slide and the third slide; the pressure release mechanism further comprising:

a channel plate having a track and a guide block, attached to the first slide;

the guide block further comprising a ramp leading to an inlet shoulder having a first redirecting surface and an inlet peak and an outlet shoulder having a second redirecting surface and an outlet peak, a latch member between the inlet and outlet shoulders and having a third redirecting surface, the inlet peak adjacent an inlet channel, the inlet channel leading to a first positioning recess, a fourth redirecting surface between the first positioning recess and a second positioning recess, the second positioning recess leading to an outlet channel, and the outlet channel adjacent the outlet peak;

the inlet peak and the outlet peak are offset such that the inlet peak is closer to the latch member;

a carriage slidably mounted on the track;

a follower having a pin and a guide post and a range of entry positions, pivotally attached to the third slide;

the pin engaging the guide block;

the guide post engaging a guide slot in the third slide; and a pair of springs fixed to the channel plate and the carriage, biasing the carriage against the channel plate.

6. The drawer slide assembly of claim 5, wherein a set of dimensions of the guide slot limits the rotation of the follower thereby guiding the pin to consistently enter the ramp.

7. The drawer slide assembly of claim 5, wherein when the drawer slide assembly enters a closing sequence, the pin enters the ramp, the first redirecting surface or the second redirecting surface directs the pin to the third redirecting surface, the third redirecting surface directs the pin through the inlet channel and into the first positioning recess, thereby rotating the follower, moving the pin into releasable engagement with the latch member, and the pair of springs biasing the carriage maintain the pin in releasable engagement with the latch member.

8. The drawer slide assembly of claim 5, wherein when the drawer slide assembly enters an opening sequence, a proximal force against the bias of the pair of springs releases the pin from engagement with the latch member, the fourth redirecting surface directs the pin into the second positioning recess, the bias of the pair of springs pulls the pin through the outlet channel, the outlet shoulder directs the pin to exit the guide block through the ramp, thereby rotating the follower and positioning the pin for further engagement with the ramp.

9. A push to open mechanism attached to a drawer slide assembly for releasably maintaining a drawer of a piece of furniture in a closed position, the push to open mechanism comprising:

a channel plate having a track and a guide block;

the guide block further comprising a ramp leading to an inlet shoulder having a first redirecting surface and an inlet peak and an outlet shoulder having a second redirecting surface and an outlet peak, a latch member between the inlet shoulder and the outlet shoulder and having a third redirecting surface, the inlet peak adjacent an inlet channel, the inlet channel leading to a first positioning recess, a fourth redirecting surface between the first positioning recess and a second positioning recess, the second positioning recess leading to an outlet channel, and the outlet channel adjacent the outlet peak;

a carriage slidingly engaged with the track;

a pair of springs connected to the track and the carriage, biasing the carriage along the track;

a follower having a range of entry positions and pivotally connected to the drawer slide assembly; and the follower including a pin for releasable engagement with the latch member and a guide post, wherein the guide post slidingly engages with the drawer slide assembly.

10. The push to open mechanism of claim 9, wherein the sliding engagement of the guide post with the drawer slide assembly limits the pivotal movement of the follower.

11. The push to open mechanism of claim 9, wherein when the push to open mechanism enters an opening sequence, a proximal force against the bias of the pair of springs releases the pin from engagement with the latch member, the fourth redirecting surface directs the pin into the second positioning recess, the bias of the pair of springs pulls the pin through the outlet channel, the outlet shoulder directs the pin to the ramp, thereby rotating the follower and positioning the pin for further engagement with the ramp.

12. A pressure release mechanism attached to a drawer slide assembly including an outer slide, an intermediate slide telescopically mounted to the outer slide, and an inner slide telescopically mounted to the intermediate slide, comprises:

a channel plate having a track and a guide block, connected to the outer slide, where an entrance to the guide block includes a first redirecting surface having an inlet peak and a second redirecting surface having an outlet peak;

the guide block defines a circuitous path having a latch surface and an inlet path adjacent the inlet peak and an outlet path adjacent the outlet peak;

a pivoting follower attached to the inner slide and having a latch pin and a range of entry positions;

a guide post attached to the pivoting follower and slidingly engaged with a guide slot in the inner slide;

a carriage slidingly engaged with and biased along a linear path on the track;

whereby the intermediate slide and the inner slide urge the carriage along the linear path and the latch pin follows the circuitous path to the latch surface to a closed retracted position in a closing sequence, and the latch pin disengages from the latch surface and follows the circuitous path to an open position in an opening sequence.

13. The pressure release mechanism of claim 12, further comprising:

the guide slot having a set of dimensions, where the set of dimensions limit the pivotal movement of the pivoting follower;

a ramp adjacent the circuitous path at the entrance; and wherein the ramp, the first redirecting surface, the second redirecting surface, and the set of dimensions direct the latch pin into the circuitous path.

14. The pressure release mechanism of claim 12, wherein the channel plate further comprises:

a plurality of redirecting surfaces surrounding the circuitous path;

a latch member protruding from the channel plate and defining the latch surface; and wherein the plurality of redirecting surfaces guide the latch pin along the circuitous path.

15. The pressure release mechanism of claim 12, wherein the latch pin follows the inlet path during the closing sequence and the latch pin follows the outlet path during the opening sequence.

16. The pressure release mechanism of claim 12, wherein during the opening sequence a proximal force is applied to the inner slide to disengage the latch pin from the latch surface.

17. The pressure release mechanism of claim 12, wherein the bias of the carriage along the linear path releasably maintains the latch pin adjacent the latch surface.

* * * * *